US009343211B2

(12) United States Patent
Yamauchi et al.

(10) Patent No.: US 9,343,211 B2
(45) Date of Patent: May 17, 2016

(54) IGNITION COIL FOR INTERNAL COMBUSTION ENGINE

(71) Applicant: DENSO CORPORATION, Kariya, Aichi-pref. (JP)

(72) Inventors: Yuhki Yamauchi, Kariya (JP); Shouichi Takeyama, Hashima (JP)

(73) Assignee: DENSO CORPORATION, Kariya (JP)

( * ) Notice: Subject to any disclaimer, the term of this patent is extended or adjusted under 35 U.S.C. 154(b) by 76 days.

(21) Appl. No.: 14/349,482

(22) PCT Filed: Oct. 4, 2012

(86) PCT No.: PCT/JP2012/075819

§ 371 (c)(1),
(2) Date: Apr. 3, 2014

(87) PCT Pub. No.: WO2013/051654

PCT Pub. Date: Apr. 11, 2013

(65) Prior Publication Data

US 2014/0345582 A1 Nov. 27, 2014

(30) Foreign Application Priority Data

Oct. 6, 2011 (JP) ..... 2011-221678
Jul. 18, 2012 (JP) ..... 2012-159184

(51) Int. Cl.
*H01F 38/12* (2006.01)
*H01F 5/00* (2006.01)
(Continued)

(52) U.S. Cl.
CPC . *H01F 5/00* (2013.01); *F02P 15/00* (2013.01); *H01F 5/04* (2013.01); *H01F 38/12* (2013.01);
(Continued)

(58) Field of Classification Search
CPC ..... H01F 38/12; H01F 2038/122; F02P 3/02; F02P 13/00; H01T 13/44
USPC ..... 123/634
See application file for complete search history.

(56) References Cited

U.S. PATENT DOCUMENTS 4,926,548 A * 5/1990 Hopkins ..... H01R 4/024 29/860
5,225,801 A 7/1993 Ida et al.
5,295,861 A * 3/1994 Peretick ..... H01F 38/12 123/647

FOREIGN PATENT DOCUMENTS

| | | |
|---|---|---|
| JP | A-62-500621 | 3/1987 |
| JP | U-2-24525 | 2/1990 |
| JP | U-4-5622 | 1/1992 |
| JP | A-9-63870 | 3/1997 |
| JP | A-2003-124043 | 4/2003 |

OTHER PUBLICATIONS

International Search Report issued in International Patent Application No. PCT/JP2012/075819 mailed Jan. 8, 2013.
(Continued)

*Primary Examiner* — Lindsay Low
*Assistant Examiner* — Charles Brauch
(74) *Attorney, Agent, or Firm* — Oliff PLC

(57) ABSTRACT

An ignition coil for an internal combustion engine is provided with a coil section that includes a primary coil and a secondary coil, and a connector case section. The primary coil is formed by winding a primary electric wire about the outer periphery of a primary spool made of a resin. The connector case section is provided with terminals each formed of a conductor and arranged from a fitting hole of the connector case section to a connector portion. In each terminal, an insertion portion arranged in the fitting hole is formed with an insertion slit in a fitting direction in which the coil section is fitted to the connector case section. Each winding end portion is drawn out substantially along a winding direction of the primary electric wire and inserted into the insertion slit in the fitting direction.

11 Claims, 8 Drawing Sheets

(51) Int. Cl.

| | |
|---|---|
| ***F02P 15/00*** | (2006.01) |
| ***H01F 5/04*** | (2006.01) |
| *F02P 3/02* | (2006.01) |
| *H01T 13/44* | (2006.01) |
| *F02P 13/00* | (2006.01) |

(52) U.S. Cl.
CPC .. *F02P 3/02* (2013.01); *F02P 13/00* (2013.01); *H01F 2038/122* (2013.01); *H01T 13/44* (2013.01)

(56) References Cited

OTHER PUBLICATIONS

Office Action issued in Japanese Patent Application No. 2012-159184 dated Sep. 3, 2013 (with translation).

International Preliminary Report on Patentability issued in PCT/JP2012/075819 mailed Apr. 8, 2014 (with translation).

* cited by examiner

IGNITION COIL FOR INTERNAL COMBUSTION ENGINE

CROSS-REFERENCE TO RELATED APPLICATION

This application is based on and claims the benefit of priority from earlier Japanese Patent Application Nos. 2011-221678 filed Oct. 6, 2011 and 2012-159184 filed Jul. 18, 2012, the description of which is incorporated herein by reference.

TECHNICAL FIELD

The present invention relates to an ignition coil for an internal combustion engine, the ignition coil being used for generating sparks in a combustion chamber of the internal combustion engine.

BACKGROUND TECHNIQUE

Ignition coils are in heavy use for igniting internal combustion engines. In such ignition coils used for internal combustion engines, a primary electric wire is wound about a primary spool to form a primary coil, while a secondary electric wire is wound about a secondary spool to form a secondary coil. Further, the primary coil and the secondary coil are concentrically arranged in a casing to form a coil section. An end of the coil section is fitted to a fitting hole of a connector case section in which an igniter is arranged.

After winding the primary electric wire about the outer periphery of the primary spool, a winding end portion of the primary electric wire is fixed to a terminal provided at the primary spool. Then, the terminal provided at the primary spool and a terminal (conductor pin) provided at the connector case section are bonded together by performing a processing, such as resistance welding or fusing.

On the other hand, for example, in an ignition coil disclosed in Patent Document 1, a winding-start side and a winding-end side of a primary coil are fixed to a winding holder portion provided at a flange portion of a primary spool. Then, a terminal is fitted and fixed to the winding holder portion provided at the flange portion to hold the winding on the winding-start side and the winding-end side. The terminal is directly arranged at a connector portion to omit an intermediate terminal that would be provided at the primary spool.

PRIOR ART DOCUMENTS

Patent Documents

[Patent Document 1] JP-A-2003-124043

SUMMARY OF THE INVENTION

Problems to be Solved by the Invention

However, in Patent Document 1, the primary electric wire is routed around the primary spool upward in the axial direction of the primary spool. Accordingly, the primary coil will have a larger size toward the upward direction. In addition, in order to further facilitate assemblage of the ignition coil, the terminal is required to have a further engineered assembling structure.

The present invention has been made in light of such background and provides an ignition coil for an internal combustion engine, the ignition coil being able to reduce the number of assembling steps and the number of parts and thus reduce the size of the ignition coil.

Means for Solving the Problems

The ignition coil for an internal combustion engine of the present invention includes as its basic configuration a coil section formed by arranging a primary coil and a secondary coil in a coil case, the primary and secondary coils being concentrically arranged at inner and outer peripheral positions; and a connector case section formed with a fitting hole for fitting an end portion of the coil section thereto, and having a connector portion for connecting and disconnecting current supplied to the primary coil. The primary coil is formed by winding a primary electric wire about an outer periphery of a primary spool made of a resin. The connector case section is provided with a terminal formed of a conductor, the terminal being arranged from inside the fitting hole to the connector portion. The terminal has an insertion portion arranged in the fitting hole, with an insertion slit being formed in the insertion portion in a fitting direction of fitting the coil section to the connector case section. The primary coil has a winding end portion drawn out substantially along a winding direction of the primary electric wire and inserted into the insertion slit in the fitting direction.

Effect of the Invention

The ignition coil for an internal combustion engine is characterized in the structures of the winding end portion of the primary coil and the terminal that electrifies the winding end portion.

Specifically, the terminal is provided in the connector case section. The terminal has the insertion portion in which the insertion slit is formed in a direction of fitting the coil section to the connector case section. Further, a winding end portion of the primary coil is drawn out substantially along the winding direction of the primary electric wire.

When the coil section is fitted to the connector case section, the winding end portion of the primary coil is inserted into the insertion slit of the insertion portion arranged in the fitting hole. In this case, the winding end portion and the terminal are bonded together by pressure-bonding the winding end portion and the terminal.

Thus, concurrently with fitting the coil section to the connector case section, the winding end portion and the terminal can be pressure-bonded. Accordingly, the winding end portion and the terminal can be quite easily bonded together (pressure-bonded) to thereby reduce the number of assembling steps of the ignition coil.

Further, in the structure in use, the terminal is provided in the connector case section and the winding end portion and the terminal are subject to pressure bonding. Use of such a structure can cease the bonding between terminals. Thus, the number of assembling steps and the number of parts of the ignition coil are reduced.

Further, the winding end portion of the primary coil is drawn out substantially along the winding direction of the primary electric wire. Accordingly, the primary coil is prevented from becoming large in the axial direction of the primary spool. Thus, the size of the ignition coil can be reduced in the axial direction. The size reduction of the ignition coil can also be achieved by not bonding between terminals.

Therefore, the ignition coil for an internal combustion engine can reduce the number of assembling steps and the number of parts and thus reduce the size of the ignition coil.

In the ignition coil having the above basic configuration for use in an internal combustion engine, the connector portion may serve as a portion that establishes electrical connection in the connector case section with a component outside the ignition coil. Also, when an igniter is arranged in the connector case section, the igniter being incorporated with a switching circuit for connecting and disconnecting current supplied to the primary coil, the connector portion may be arranged in the vicinity of the igniter.

Further, as a preferred example, the insertion portion may have a pair of opposing plate portions having mutually opposed plate surfaces formed in a band-plate shape, and an end plate portion leading to end portions of the pair of opposing plate portions. Further, the insertion slit may be continuously formed, dividing the end plate portion, up to the pair of opposing plate portions. In this case, rigidity of the insertion portion of the terminal can be easily ensured.

MODES FOR IMPLEMENTING THE INVENTION

With reference to FIGS. 1 to 11, hereinafter is described an embodiment of an ignition coil for an internal combustion engine.

First, an outline of the ignition coil for an internal combustion engine is described.

Figure 1:
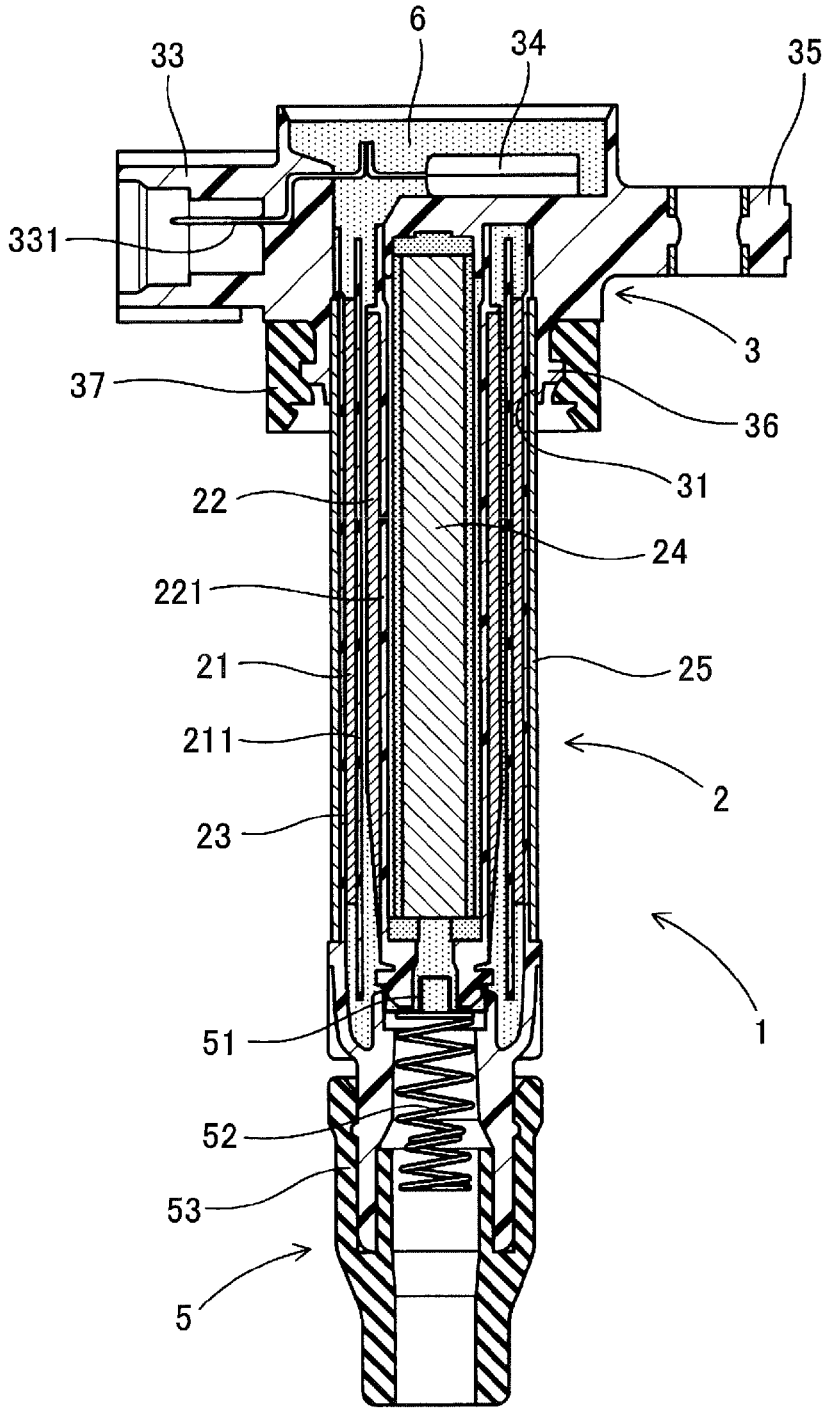
FIG. 1 is a cross-sectional view illustrating an ignition coil for an internal combustion engine, as viewed from the front, according to a first embodiment.

FIG. 1 illustrates a cross section of an ignition coil 1 for an internal combustion engine (hereinafter just referred to as ignition coil 1) as viewed from the front.

As shown in the figure, the ignition coil 1 includes a coil section 2 which is formed by arranging a primary coil 21 and a secondary coil 22 in a coil case 23, the coils being concentrically arranged at inner and outer periphery positions. The ignition coil 1 also includes a connector case section 3 which is formed with a fitting hole 31 for fitting an end portion of the coil section 2 thereto and has a connector portion 32 for connecting and disconnecting current supplied to the primary coil 21.

Figure 2:
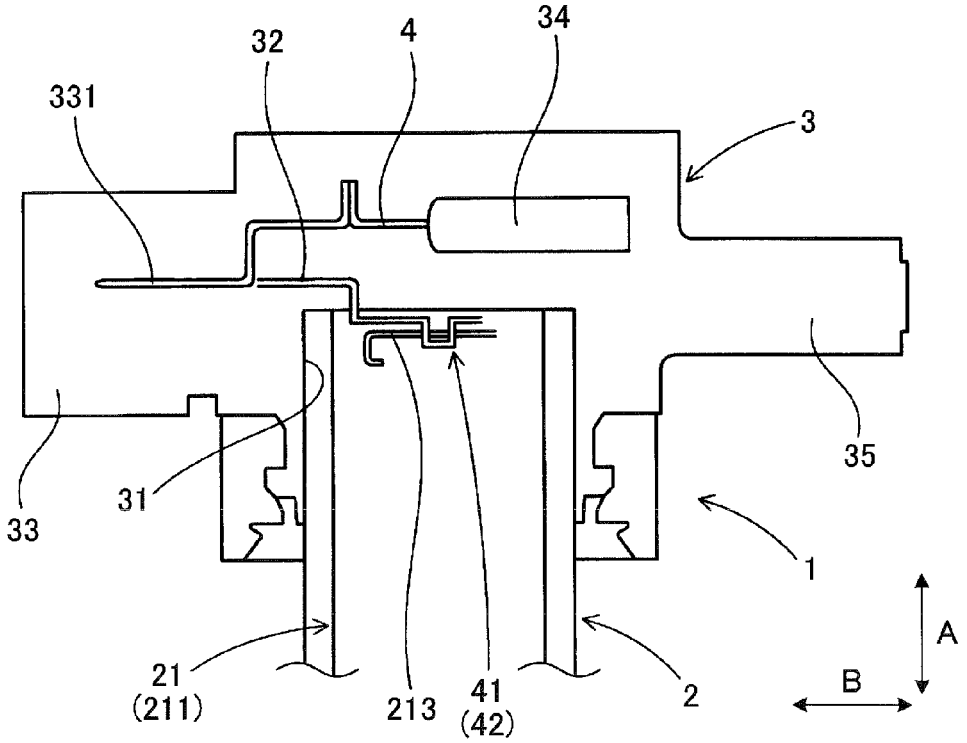
FIG. 2 is an explanatory view schematically illustrating the arrangement of a terminal neighboring a connector case section as viewed from the front, according to the embodiment.
Figure 3:
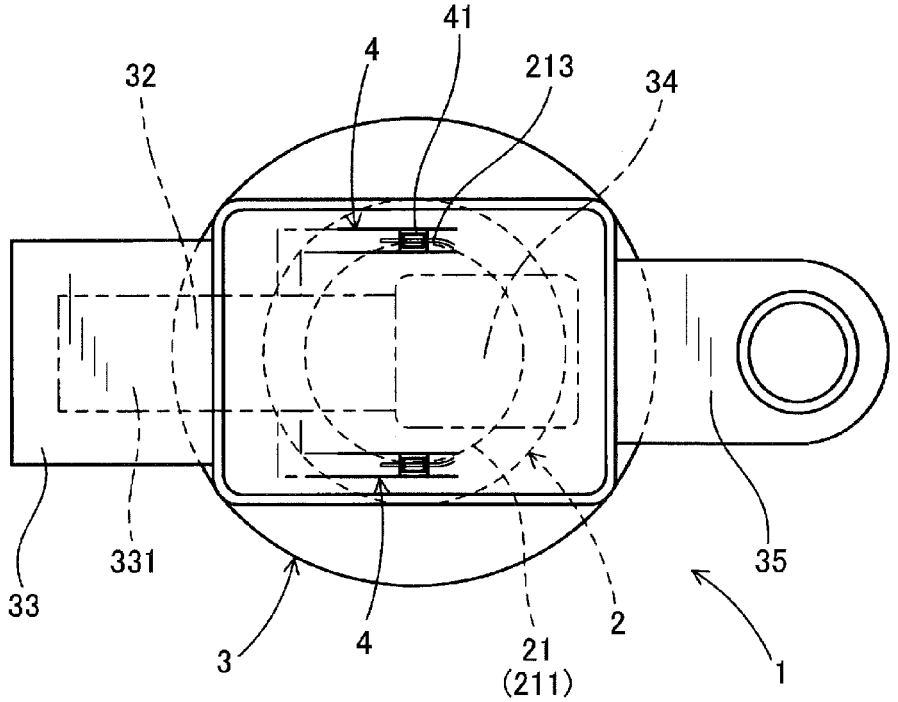
FIG. 3 is an explanatory view schematically illustrating the arrangement of the terminal neighboring the connector case section as viewed from the top, according to the embodiment.
Figure 4:
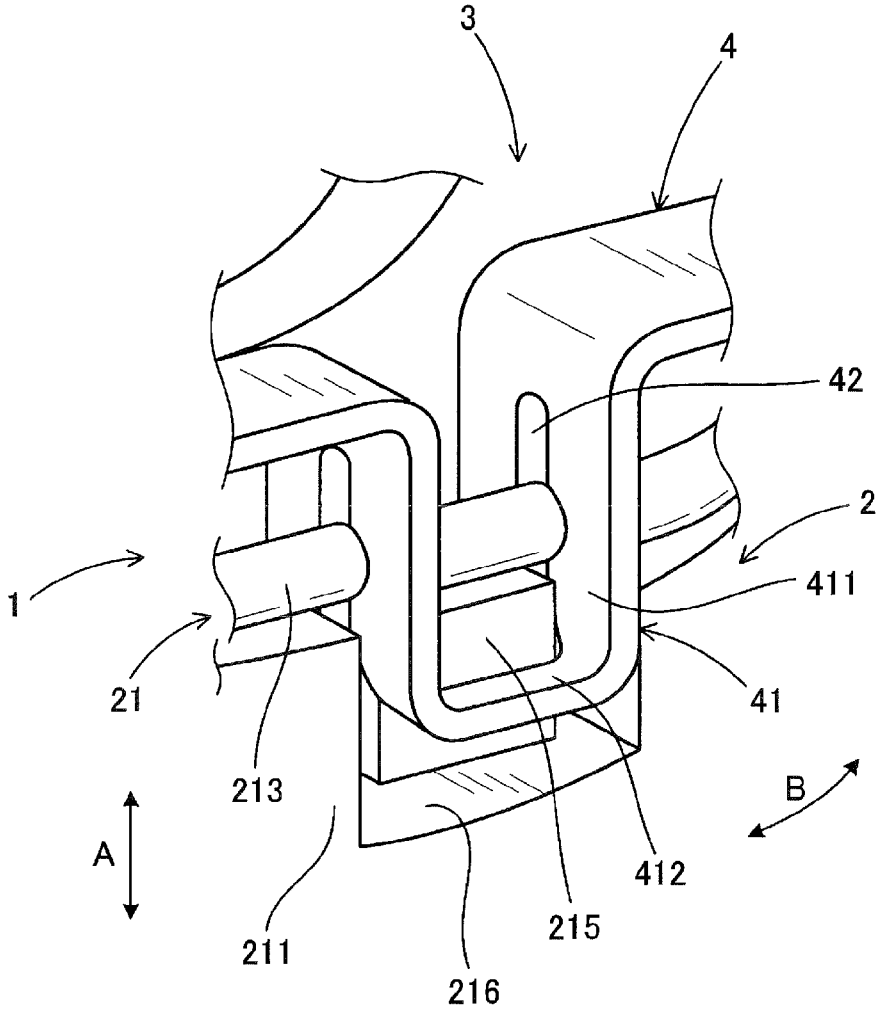
FIG. 4 is a perspective view illustrating a state where a winding end portion of a primary coil is inserted into an insertion slit in an insertion portion of the terminal, according to the embodiment.

FIG. 2 schematically illustrates the arrangement of a terminal 4 neighboring the connector case section 3, as viewed from the front. FIG. 3 schematically illustrates the arrangement of the terminal 4 neighboring the connector case section 3, as viewed from the top. FIG. 4 illustrates a state where a winding end portion 213 of the primary coil 21 is inserted into an insertion slit 42 in an insertion portion 41 of the terminal 4. In FIGS. 2 and 3, the shape of the terminal 4 near a connector portion 32 is schematically shown.

As shown in FIGS. 2 and 3, the primary coil 21 is formed by winding a primary electric wire 212 about the outer periphery of a primary spool 211 which is made of a resin. The connector case section 3 is provided with the terminal 4 which is formed of a conductor and extends from inside the fitting hole 31 to the connector portion 32. As shown in FIG. 4, in the terminal 4, the insertion slit 42 is formed in the insertion portion 41, which is arranged in the fitting hole 31, so as to extend in a fitting direction A in which the coil section 2 is fitted to the connector case section 3. The winding end portion 213 of the primary coil 21 is drawn out substantially along a winding direction B of the primary electric wire 212 and inserted into the insertion slit 41 in the fitting direction A.

Hereinafter, the structure of the ignition coil 1 is specifically described.

As shown in FIG. 1, the ignition coil 1 of the present embodiment is used, with the coil section 2 being arranged in a plug hole of an engine as an internal combustion engine and the connector case section 3 being arranged outside the plug hole. The coil section 2 has an axial upper end portion to which the connector case section 3 is fitted, and an axial lower end portion which is provided with a plug mounting section 5 that is conductive with a spark plug.

In the coil section 2, a center core 24 made of a soft magnetic material is arranged on an inner peripheral side of the primary coil 21 and the secondary coil 22, while an outer peripheral core 25 made of a soft magnetic material is arranged on an outer peripheral side of the coil case 23. The secondary coil 22 is formed by winding a secondary electric wire, which is thinner than the primary electric wire 212, about the outer periphery of the secondary spool 221, with the number of turns larger than that of the primary coil 21.

As shown in the figure, the plug mounting section 5 is configured by: a high voltage terminal 51 which is conductive with a high voltage winding end portion of the secondary coil 22 in an axially lower end portion of the primary spool 211; a coil spring 52 which is conductive with the high voltage terminal 51 and electrifies an electrode portion of the spark plug; and a plug cap 53 into which an insulator portion of the spark plug is press-fitted.

The fitting hole 31 of the connector case section 3 is formed through the connector case section 3. The axial upper end portion of the coil section 2 is fitted into the fitting hole 31 of the connector case section 3 from below the fitting hole 31. When the coil section 2 and the connector case section 3 are fitted to each other, the center core 24, the primary coil 21 and the secondary coil 22 are axially centered with each other.

Gaps formed in the coil section 2 and the coil case section 3 are filled with an epoxy resin 6 as a thermosetting resin.

In the connector case section 3, an interior 34 is arranged, being integrated with a switching circuit to connect and disconnect current supplied to the primary coil 21. The connector case section 3 is provided with a connector terminal portion 33 in which a plurality of conductor pins 331 are arranged being arrayed, and a mounting portion 35 which is used for fixing the ignition coil 1 to the engine, the connector terminal portion 33 and the mounting portion 35 being projected radially outward.

In the connector terminal portion 33, the plurality of conductor pins 331, such as a plus-side power supply pin, a minus-side power supply pin and a switching signal pin, are arranged being arrayed.

The connector case section 3 has a lower end portion in which a cylindrically projected portion 36 is formed. The cylindrically projected portion 36 is provided with a seal rubber 37 to prevent entry of water into the plug hole.

As shown in FIGS. 2 and 3, the connector portion 32 of the present embodiment is formed as a conductor pin 331 arranged in the connector terminal portion 33. The terminal 4 is formed extending from the insertion portion 41 positioned in the fitting hole 31 to the conductor pins 331 arranged in the connector terminal portion 33. It should be appreciated that the terminal 4 may be formed, being directly drawn out of the igniter 34.

A pair of winding end portions 213 positioned at both ends of the primary coil 21 are drawn out in a pair in the axially upper end portion of the primary spool 211, at mutually opposed positions in the circumferential direction of the primary spool 21.

Figure 5:
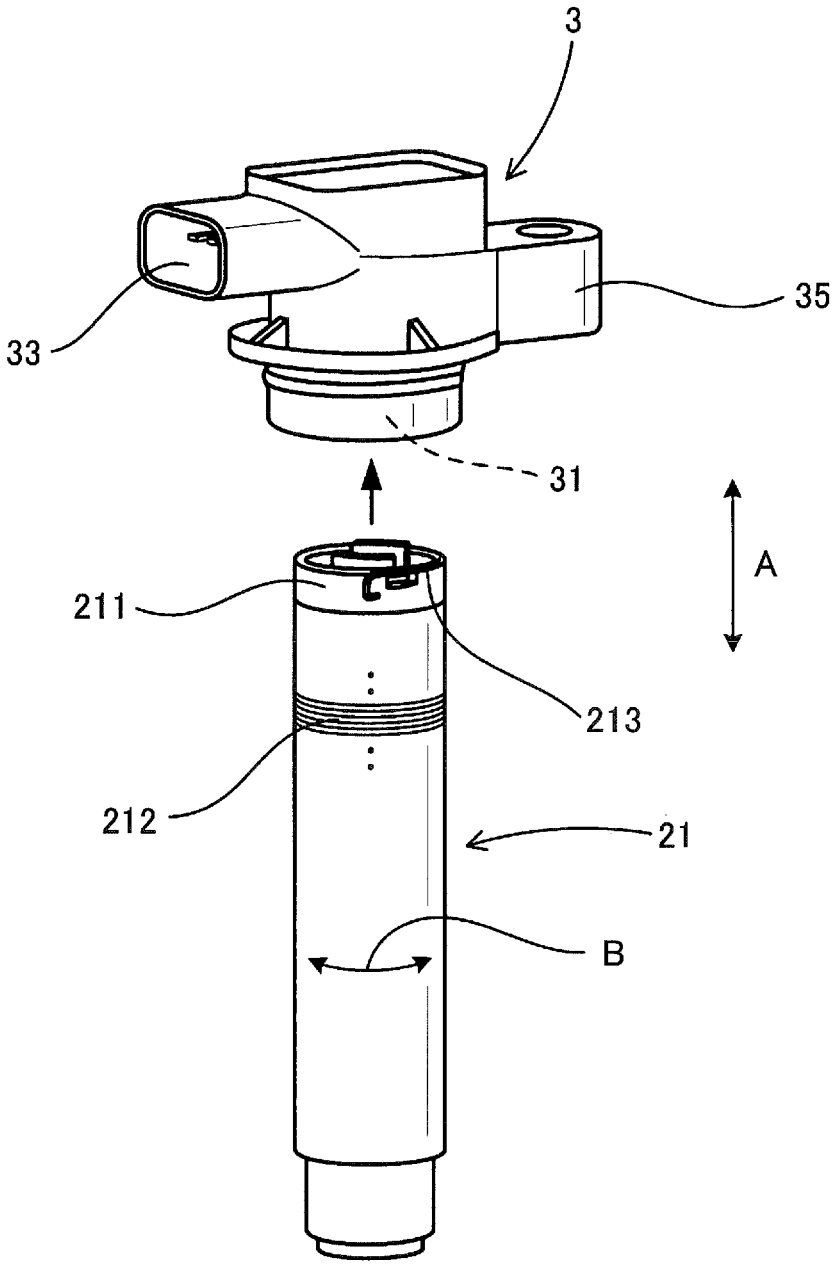
FIG. 5 is a perspective view illustrating a state where an end portion of a coil section is fitted to a fitting hole of the connector case section, according to the embodiment.

The terminals 4, which electrify the primary coil 21, are arranged in a pair inside the connector case section 3. The insertion portions 41 provided in the terminals 4 are arranged in a pair at mutually opposed positions in the circumferential direction of the fitting hole 31 of the connector case section 3. As shown in FIG. 5, the ignition coil 1 of the present embodiment is configured such that the pair of winding end portions 213 are inserted into the respective insertion slits 42 of the pair of insertion portions 41 when the coil section 2 is fitted to the connector case section 3. The figure illustrates a state where an end portion of the coil section 2 is fitted to the fitting hole 31 of the connector case section 3.

As shown in FIG. 4, the insertion portion 41 of each terminal 4 includes: a pair of opposing plate portions 411 having respective plate surfaces in a band-plate shape, which are opposed to each other; and an end plate portion 412 that leads to ends of the pair of opposing plate portions 411. The insertion portion 41 is formed such that the end plate portion 412 is provided on a lower side with respect to the pair of opposing plate portions 411 so as to face the coil section 2.

As shown in FIG. 5, the primary coil 21 is formed by winding the primary electric wire 212 about the outer periphery of the primary spool 211 and fixing the winding end portions 213 of the primary electric wire 212 to the axial upper end portion of the primary spool 211.

As shown in FIG. 4, a backup portion 215 is formed in the axial upper end portion of the primary spool 211. The backup portion 215 backs up the corresponding winding end portion 213 of the primary coil 21 when the winding end portion 213 is inserted into the insertion slit 42 of the insertion portion 41 of the terminal 4. The backup portion 215 is formed so as to receive, from below (axial center side), the winding end portion 213 of the primary coil 21, which is drawn out substantially along the winding direction B of the primary electric wire 212. The backup portion 215 has an upper surface which may be formed, for example, with a groove that holds the winding end portion 213 of the primary coil 21.

At a position where each backup portion 215 is formed in the axial upper end portion of the primary spool 211, a recessed portion 216 is formed to place therein the pair of opposing plate portions 411 and the end plate portion 412 of the corresponding insertion portion 41.

Figure 6:
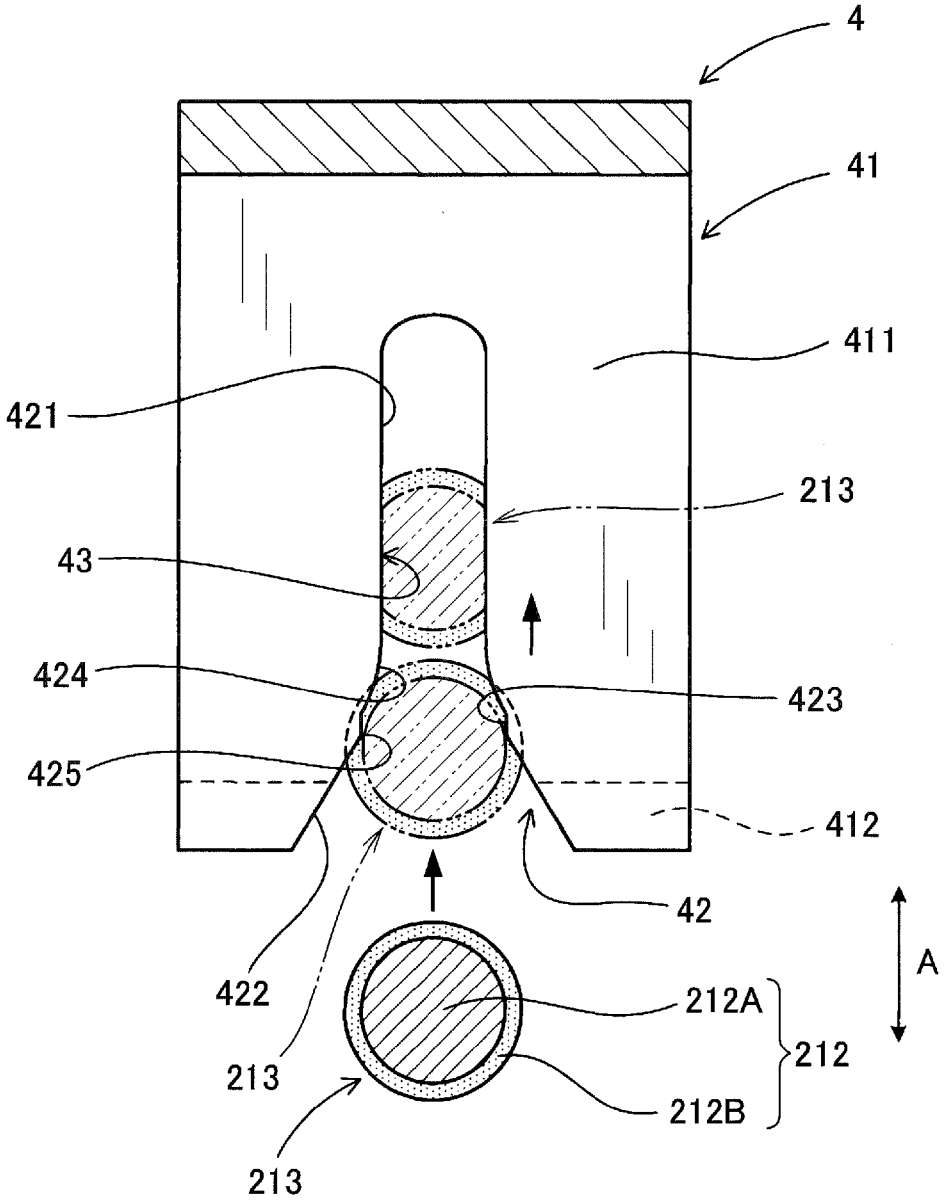
FIG. 6 is an explanatory view illustrating a state where the winding end portion of the primary coil is inserted into the insertion slit in the insertion portion of the terminal, according to the embodiment.

FIG. 6 illustrates a state where the winding end portion 213 of the primary coil 21 is inserted into the insertion slit 42 of the insertion portion 41 of the corresponding terminal 4.

As shown in the figure, the primary electric wire 212 is formed by coating an insulating film 212B made of a resin material around a conductor portion 212A made such as of a copper material. The structure for providing an insulating film around a conductor portion is also applied to the secondary electric wire. When the primary electric wire 212, as the winding end portion 213 of the primary coil 21, is inserted into the insertion slit 42 of the terminal 4, the insulating film 212B and the conductor portion 212A are partially shaved off to pressure-bond the conductor portion 212A to the terminal 4.

Figure 8:
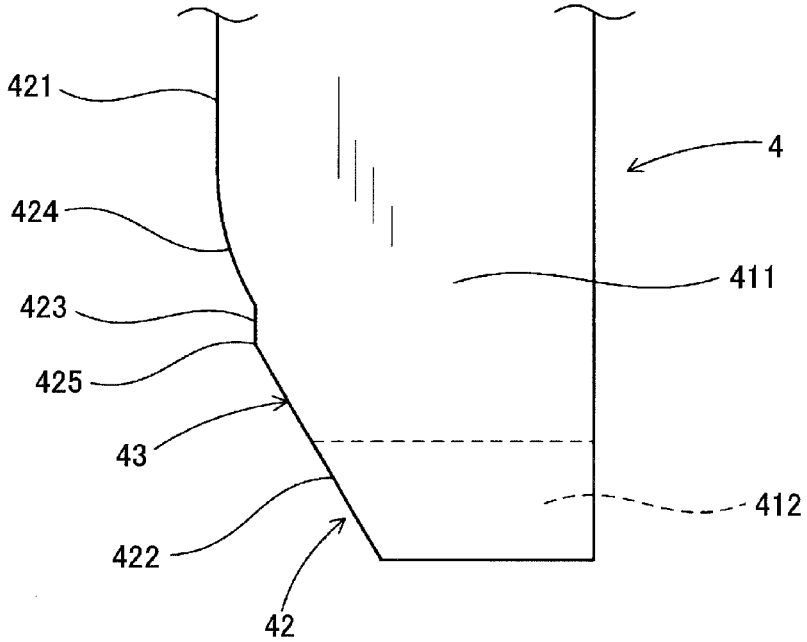
FIG. 8 is an enlarged explanatory view illustrating the neighbor of the insertion slit in an opposing plate portion, according to the embodiment.

FIG. 8 illustrates an enlarged neighbor of the insertion slit 42 in the opposing plate portions 411. As shown in the figure, the insertion slit 42 of the present embodiment includes: a slit body portion 421 formed of mutually parallel end faces 43 of the pair of opposing plate portions 411; and slit guide portions 422 which are continuously formed from the slit body portion 421 toward an opening where the end plate portion 412 is positioned, while being gradually expanded in its slit width toward the opening. On a deep side in the slit guide portion 422 opposite to the opening, expanded portions 423 are formed parallel to the slit body portion 421, with a width therebetween being larger than the width of the slit body portion 421. On a deep side in the expanded portions 423, tapered portions 424 leading to the slit body portion 421 are formed. The tapered portions 424 are each formed in a round shape that is curved toward the insertion slit 42. Further, edged corner portions 425 are formed such that each of which is located between the slit guide portion 422 and the expanded portion 423.

As shown in FIG. 6, the slit guide portions 422 have a function as a part for stably guiding the winding end portion 213 of the primary coil 21 toward the slit body portion 421 when the winding end portion 213 is inserted into the insertion slit 42. The edged corner portions 425 have a function as a part for shaving off (separating) the insulating film 212B in the winding end portion 213 of the primary coil 21 when the winding end portion 213 is inserted into the insertion slit 42. The tapered portions 424 have a function as a part for shaving off the conductor portion 212A of the winding end portion 213 of the primary coil 21 after the shaving off of the insulating film 212B, when the winding end portion 213 is inserted into the insertion slit 42. After the partial shaving off of the insulating film 212B and the conductor portion 212A, the winding end portion 213 of the primary coil 21 is pressure-bonded to the slit body portion 421.

Figure 7:
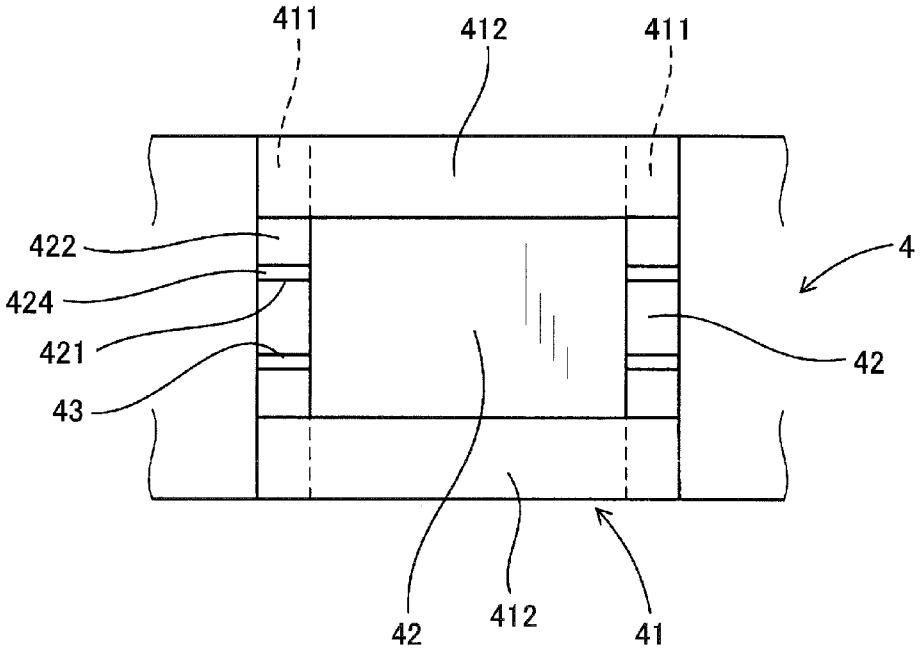
FIG. 7 is an explanatory view illustrating the insertion portion of the terminal as viewed from below, according to the embodiment.

FIG. 7 illustrates the insertion portion 41 of the terminal 4 as viewed from below. As shown in the figure, the insertion slit 42 is provided from below in the end plate portion 412 and the pair of opposing plate portions 411, i.e. the insertion slit 42 is formed, dividing the end plate portion 412 and continuing to the pair of opposing plate portions 411.

The slit guide portions 422, the expanded portions 423, the tapered portions 424 and the end faces 43 of the slit body portion 421 may be formed so as to be perpendicular to the plate surfaces of the opposing plate portions 411.

Figure 9:
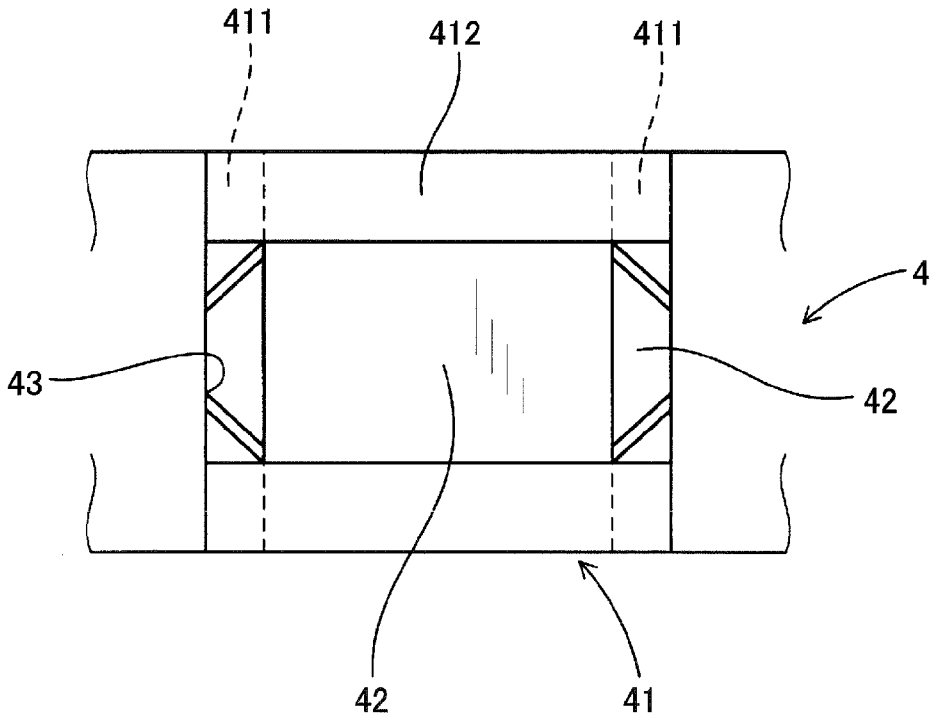
FIG. 9 is an explanatory view illustrating an insertion portion of a different terminal as viewed from below, according the embodiment.
Figure 10:
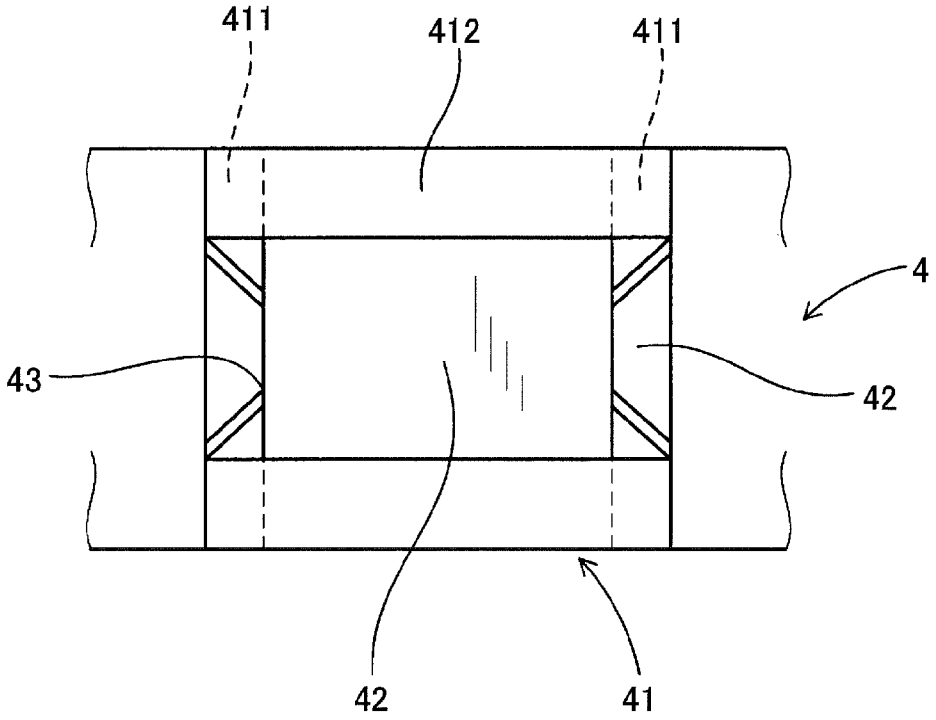
FIG. 10 is an explanatory view illustrating an insertion portion of another different terminal as viewed from below, according to the embodiment.
Figure 11:
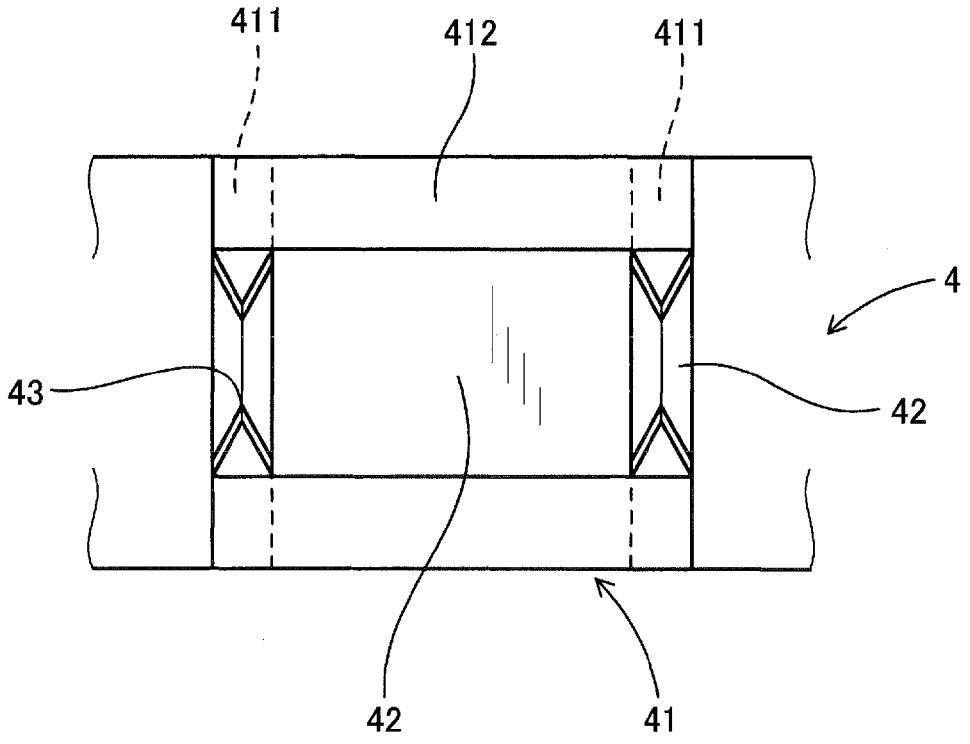
FIG. 11 is an explanatory view illustrating an insertion portion of still another different terminal as viewed from below, according to the embodiment.

As shown in FIGS. 9 to 11, the end faces 43 of the insertion slit 42 may have a cross-sectional shape with sharpened ends. FIG. 9 shows the case where outer ends of the pair of opposing plate portions 411 that are opposed to each other are sharpened in the end faces 43. FIG. 10 shows the case where inner ends of the pair of opposing plate portions 411 that are opposed to each other are sharpened in the end faces 43. FIG. 11 shows the case where center portions of the pair of opposing plate portions 411 that are opposed to each other are sharpened in the end faces 43.

In the ignition coil 1 of the present embodiment, the structure is engineered in each winding end portion 213 of the primary coil 21 and in the corresponding terminal 4 that electrifies the winding end portion 213.

Specifically, the pair of terminals 4 are provided in the connector case section 3. The pair of terminals 4 have the respective insertion portions 41 in which the respective insertion slits 42 are formed in the fitting direction A in which the coil section 2 is fitted to the connector case section 3. The winding end portions 213 at both ends of the primary coil 21 are drawn out substantially along the winding direction B of the primary electric wire 212.

As shown in FIGS. 5 and 6, the winding end portions 213 of the primary coil 21 are inserted into the respective insertion slits 42 of the respective insertion portions 41 arranged in the fitting hole 31, when the coil section 2 is fitted to the connector case section 3. In fitting an end portion of the coil section 2 to the fitting hole 31 of the connector case section 3, each winding end portion 213 is guided toward the center of the opposing plate portions 411 by the slit guide portions 422, while the insulating film 212B is shaved off by the edged corner portions 425. Then, after passing between the pair of expanded portions 423, the conductor portion 212A of the winding end portion 213 is partially shaved off by the tapered portions 424, so that the remnant of the conductor portion 212A is pressure-bonded to the terminal 4.

In this way, the winding end portions 213 and the respective terminals 4 are bonded together by pressure-bonding the winding end portions 213 to the respective terminals 4. Thus, concurrently with the fitting of the coil section 2 to the connector case section 3, the pair of winding end portions 213 are pressure-bonded to the pair of terminals 4. Accordingly, the pair of winding end portions 213 are quite easily bonded (pressure-bonded) to the pair of terminals 4, thereby reducing the number of assembling steps of the ignition coil 1.

Further, around each terminal 4, the epoxy resin 6 is filled in. When the epoxy resin 6 is cured, stress is generated. The stress acting on the epoxy resin 6 is generated in a contracting manner and thus the stress will act in a direction of narrowing the insertion slit 42 of the terminal 4. Use of the curing and contractive force of the epoxy resin 6 can increase the contact force between the conductor portion 212A of each winding end portion 213 of the primary coil 21 and the corresponding terminal 4 to reliably subject them to pressure bonding.

Further, the end plate portion 412 which leads to the ends of the pair of opposing plate portions 411 is arranged parallel to the corresponding winding end portion 213. Accordingly, the winding end portion 213 will easily receive the curing and contractive force of the epoxy resin 6. Thus, the conductor portion 212A of the winding end portion 213 can be reliably pressure-bonded to the terminal 4.

In the structure in use, the pair of terminals 4 are provided in the connector case section 3, and the pair of winding end portions 213 are pressure-bonded to the pair of terminals 4, thereby ceasing the bonding between the terminals 4. This reduces the number of assembling steps and the number of parts of the ignition coil 1.

Further, the winding end portions 213 at both ends of the primary coil 21 are drawn out substantially along the winding direction B of the primary electric wire 212. Thus, the primary coil 21 is prevented from becoming large in the axial direction of the primary spool 211 (the same as the fitting direction A). Accordingly, the size of the ignition coil 1 can be reduced in the axial direction. The size reduction of the ignition coil 1 can also be achieved by the cease of the bonding between the terminals 4.

Therefore, according to the ignition coil 1 of the present embodiment, the number of assembling steps and the number of parts are reduced and hence the size of the ignition coil is reduced.

The present invention is not necessarily limited to the foregoing embodiment but may be further developed in various ways as far as the development does not depart from the spirit of the present invention recited in the claims.

DESCRIPTION OF THE SYMBOLS

1 Ignition coil for internal combustion engine
2 Coil section
21 Primary coil
211 Primary spool
212 Primary electric wire
213 Winding end portion
22 Secondary coil
23 Coil case
3 Connector case section
31 Fitting hole
32 Connector portion
4 Terminal
41 Insertion portion
411 Opposing plate portion
412 End plate portion
42 Insertion slit
421 Slit body portion
422 Slit guide portion
423 Expanded portion
424 Tapered portion
425 Corner portion

The invention claimed is:

1. An ignition coil for an internal combustion engine, the ignition coil comprising:

a coil section formed by arranging a primary coil and a secondary coil in a coil case, the primary and secondary coils being arranged at inner and outer periphery positions in a concentric manner; and a connector case section formed with a fitting hole for fitting an end portion of the coil section thereto, and having a connector portion for connecting and disconnecting current supplied to the primary coil; and a thermosetting resin filled in spaces formed in the coil section and in the connector case section, wherein, the primary coil is formed by winding a primary electric wire about an outer periphery of a primary spool made of a resin, the connector case section is provided with a terminal formed of a conductor, the terminal being arranged from inside the fitting hole to the connector portion, the terminal has an insertion portion arranged in the fitting hole, with an insertion slit being formed in the insertion portion in a fitting direction of fitting the coil section to the connector case section, the primary coil has a winding end portion drawn out substantially along a winding direction of the primary electric wire and inserted into the insertion slit in the fitting direction, the insertion portion comprises:

a pair of opposing plate portions each having a plate surface in a band-plate shape, the plate surfaces of the opposing plate portions being mutually opposed to each other; and an end plate portion that leads to ends of the pair of opposing plate portions, the insertion slit is formed such that the insertion slit divides the end plate portion and continues to the pair of opposing plate portions, the thermosetting resin contacts the pair of opposing plate portions and the end plate portion, and curing and contractive force of the thermosetting resin caused when the thermosetting resin is cured acts on the terminal in a direction of narrowing the insertion slit.

2. The ignition coil for an internal combustion engine according to claim 1, wherein the primary spool has an end portion that is formed with a backup portion for backing up the winding end portion when the winding end portion of the primary coil is inserted into the insertion slit.

3. The ignition coil for an internal combustion engine according to claim 1, wherein the winding end portions of the primary coil are drawn out in a pair at mutually opposed positions in a circumferential direction of the primary spool;

the terminals are arranged in a pair inside the connector case section;

the insertion portions provided in the pair of terminals are arranged in a pair at mutually opposed positions in a circumferential direction of the fitting hole in the connector case section; and the pair of winding end portions are configured to be inserted into the insertion slits in the pair of insertion portions when the coil section is fitted to the connector case section.

4. The ignition coil for an internal combustion engine according to claim 1, wherein the insertion slit includes a slit body portion that is formed of mutually parallel end faces a pair of opposing plate portions, and slit guide portions that are formed continuously from the slit body portion toward an opening in which the end plate portion is positioned, the slit guide portions being gradually expanded toward the opening.

5. The ignition coil for an internal combustion engine according to claim 1, wherein expanded portions having a width therebetween larger than that of the slit body portion are formed parallel to the slit body portion, on a deep side in the slit guide portions opposite to an opening in which the end plate portion is positioned;

tapered portions that lead to the slit body portion are formed on the deep side in the expanded portions; and edged corner portions are formed, each being located between the slit guide portion and the expanded portion.

6. The ignition coil for an internal combustion engine according to claim 1, wherein the winding end portions of the primary coil are drawn out in a pair at mutually opposed positions in a circumferential direction of the primary spool;

the terminals are arranged in a pair inside the connector case section;

the insertion portions provided in the pair of terminals are arranged in a pair at mutually opposed positions in a circumferential direction of the fitting hole in the connector case section; and the pair of winding end portions are configured to be inserted into the insertion slits in the pair of insertion portions when the coil section is fitted to the connector case section.

7. The ignition coil for an internal combustion engine according to claim 6, wherein the insertion slit includes a slit body portion that is formed of mutually parallel end faces in a pair of opposing plate portions, and slit guide portions that are formed continuously from the slit body portion toward an opening in which the end plate portion is positioned, the slit guide portions being gradually expanded toward the opening.

8. The ignition coil for an internal combustion engine according to claim 7, wherein expanded portions having a width therebetween larger than that of the slit body portion are formed parallel to the slit body portion, on a deep side in the slit guide portions opposite to the opening;

tapered portions that lead to the slit body portion are formed on the deep side in the expanded portions; and edged corner portions are formed, each being located between the slit guide portion and the expanded portion.

9. The ignition coil for an internal combustion engine according to claim 3, wherein the insertion slit includes a slit body portion that is formed of mutually parallel end faces in a pair of opposing plate portions, and slit guide portions that are formed continuously from the slit body portion toward an opening in which the end plate portion is positioned, the slit guide portions being gradually expanded toward the opening.

10. The ignition coil for an internal combustion engine according to claim 9, wherein expanded portions having a width therebetween larger than that of the slit body portion are formed parallel to the slit body portion, on a deep side in the slit guide portions opposite to the opening;

tapered portions that lead to the slit body portion are formed on the deep side in the expanded portions; and edged corner portions are formed, each being located between the slit guide portion and the expanded portion.

11. The ignition coil for an internal combustion engine according to claim 4, wherein expanded portions having a width therebetween larger than that of the slit body portion are formed parallel to the slit body portion, on a deep side in the slit guide portions opposite to the opening;

tapered portions that lead to the slit body portion are formed on the deep side in the expanded portions; and edged corner portions are formed, each being located between the slit guide portion and the expanded portion.

* * * * *